US011453847B2

(12) United States Patent
Lee et al.

(10) Patent No.: US 11,453,847 B2
(45) Date of Patent: Sep. 27, 2022

(54) LAUNDRY SHEET

(71) Applicant: NEXTUP CO., LTD., Gyeonggi-do (KR)

(72) Inventors: Jung Kyu Lee, Gyeonggi-do (KR); Jun Ho Kim, Gyeonggi-do (KR); Ga Eun Yong, Gyeonggi-do (KR); Kai Wei Wu, Guangdong (CN)

(73) Assignee: NEXTUP CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/051,568

(22) PCT Filed: May 2, 2019

(86) PCT No.: PCT/KR2019/005283

§ 371 (c)(1),
(2) Date: Oct. 29, 2020

(87) PCT Pub. No.: WO2019/212266

PCT Pub. Date: Nov. 7, 2019

(65) Prior Publication Data

US 2021/0222096 A1 Jul. 22, 2021

(30) Foreign Application Priority Data

May 2, 2018 (KR) ..... 10-2018-0050665
May 2, 2019 (KR) ..... 10-2019-0051664

(51) Int. Cl.
*C11D 1/12* (2006.01)
*C11D 1/14* (2006.01)
(Continued)

(52) U.S. Cl.
CPC ..... *C11D 17/06* (2013.01); *C11D 1/146* (2013.01); *C11D 1/72* (2013.01); *C11D 1/74* (2013.01);
(Continued)

(58) Field of Classification Search
CPC .... C11D 1/12; C11D 1/14; C11D 1/66; C11D 1/72; C11D 1/74; C11D 1/75; C11D 1/83; C11D 3/37; C11D 3/3753; C11D 17/049
See application file for complete search history.

(56) References Cited

U.S. PATENT DOCUMENTS 6,827,795 B1 12/2004 Kasturi et al.
7,214,650 B2 5/2007 Kasturi et al.
(Continued)

FOREIGN PATENT DOCUMENTS

CN 106978264 A 7/2017
CN 107760479 A 3/2018
(Continued)

OTHER PUBLICATIONS

First Office Action dated Jun. 28, 2021 for corresponding Chinese Application No. 201980029266.X and English translation.
(Continued)

*Primary Examiner* — Brian P Mruk
(74) *Attorney, Agent, or Firm* — Pearne & Gordon LLP

(57) ABSTRACT

The present disclosure relates to a laundry sheet manufactured using polyvinyl alcohol or a polyvinyl-alcohol-based copolymer and containing a surfactant, in which the surfactant includes a main surfactant and a cosurfactant. The main surfactant includes a first main surfactant and a second main surfactant, and the first main surfactant and the second main surfactant are different from each other, each of the first main surfactant and the second main surfactant independently including a C8-C18 alkyl sulfate alkali metal salt. The cosurfactant includes two or more different surfactants, one of which is fatty acid alkyl ester alkoxylate and the remaining one of which is a nonionic surfactant.

10 Claims, 9 Drawing Sheets

(51) Int. Cl.

| | |
|---|---|
| ***C11D 1/66*** | (2006.01) |
| ***C11D 1/72*** | (2006.01) |
| ***C11D 1/74*** | (2006.01) |
| ***C11D 1/75*** | (2006.01) |
| ***C11D 1/83*** | (2006.01) |
| ***C11D 3/37*** | (2006.01) |
| ***C11D 17/06*** | (2006.01) |
| ***C11D 3/20*** | (2006.01) |

(52) U.S. Cl.
CPC ..... *C11D 1/75* (2013.01); *C11D 1/83* (2013.01); *C11D 3/2093* (2013.01); *C11D 3/3753* (2013.01)

(56) References Cited

U.S. PATENT DOCUMENTS

| | | | | |
|---|---|---|---|---|
| 2002/0013251 | A1* | 1/2002 | Hayashi ..... | C11D 3/3942 510/445 |
| 2008/0103084 | A1 | 5/2008 | Banco et al. | |
| 2010/0150976 | A1 | 6/2010 | Schnitzler et al. | |
| 2012/0315689 | A1 | 12/2012 | Adams et al. | |

FOREIGN PATENT DOCUMENTS

| | | | |
|---|---|---|---|
| CN | 107881043 | A | 4/2018 |
| EA | 013329 | B1 | 4/2010 |
| JP | 1993-271695 | A | 10/1993 |
| JP | 2001-262197 | A | 9/2001 |
| JP | 2001-294899 | A | 10/2001 |
| JP | 2003-500525 | A | 1/2003 |
| JP | 2003-166000 | A | 6/2003 |
| JP | 2005-239786 | A | 9/2005 |
| JP | 2010-523746 | A | 7/2010 |
| KR | 10-2005-0023675 | A | 3/2005 |
| KR | 10-2010-0096985 | A | 9/2010 |
| KR | 10-1146292 | B1 | 5/2012 |
| KR | 10-2012-0130688 | A | 12/2012 |
| KR | 10-2015-0095815 | A | 8/2015 |
| KR | 10-2017-0066078 | A | 6/2017 |
| WO | 00/71658 | A1 | 11/2000 |
| WO | 2017-105131 | A1 | 6/2017 |
| WO | 2018/045478 | A1 | 3/2018 |

OTHER PUBLICATIONS

Notice of Reasons for Refusal dated Oct. 21, 2021 for corresponding Japanese Application No. 2020-560988 and English translation.
Korean Grant of Patent dated Dec. 27, 2019 for corresponding Korean Application No. 2019-0051664 and English translation.
Russian Search Report dated Mar. 3, 2021 for corresponding Russian Application No. 065750 (based on International Application No. PCT/KR2019/005283.
D2 Reference; China Cleaning Industry, New Technologies & Products, Oct. 2014, pp. 36-41.
Bin Yuguan, "Household Washing and Spinning Agent Forumal Design/Grinding Text", China Light Industry Publishing Co., Ltd., Beijing, 2000; JISBN7-5019-2702-2.
International Search Report for corresponding International Application No. PCT/KR2019/005283 dated Aug. 14, 2019.
Written Opinion for corresponding International Application No. PCCT/KR2019/005283 dated Aug. 14, 2019.
Korean Office Action for corresponding Korean Application No. 10-2019-0051664 dated Sep. 30, 2019.
Notice of Reasons for Refusal dated May 26, 2022 for corresponding Japanese Application No. 2020-560988 and English translation.

* cited by examiner

Example 1

Comparative Example 1

Comparative Example 2

Example 1

Comparative Example 1

Comparative Example 2

LAUNDRY SHEET

CROSS REFERENCE TO RELATED APPLICATION

The present application is based on and claims priority of International application PCT/KR2019/005283 filed on May 2, 2019, which claims priority from Korean patent application no. 2018-0050665 filed May 2, 2018, and Korean patent application no. 2019-0051664 filed May 2, 2019. The entire disclosures of the above-identified applications, including their specifications, drawings and claims are incorporated herein by reference in their entireties.

TECHNICAL FIELD

The present disclosure relates to a laundry sheet.

BACKGROUND

As detergents for washing machines, powder detergents, and liquid detergents have been generally used to date. However, powder detergents are disadvantageous in that powder creates dust, and liquid detergents are disadvantageous in that they are inconvenient to transport or use because they are heavy.

As a new type of detergent, U.S. Pat. No. 4,605,509 discloses a detergent in which a liquid detergent component and a fabric softener are sealed in a water-soluble film bag. However, when the product is stored or transported, there is a problem in that the storage stability of the product is very poor, causing a problem of leakage of the contents of the film bag due to bursting of the sealed film bag, a problem of active ingredients permeating through the surface of the film, and the like.

With the goal of solving these problems, a sheet-type solid detergent has been developed as a new type of laundry sheet, but there is a concern in that it may cause irritation and damage to the skin due to the alkalinity thereof, and the solubility of the sheet alone is very unsatisfactory.

BRIEF SUMMARY

One of the objectives of the present disclosure is to provide a novel laundry sheet, which has high cleaning power and is superior in various performance aspects, such as solubility, softness, etc., as a sheet detergent.

In order to accomplish the above objective, an embodiment of the present disclosure provides a laundry sheet manufactured using polyvinyl alcohol (PVA) or a polyvinyl-alcohol-based copolymer and containing a surfactant, in which the surfactant includes a main surfactant and a cosurfactant, the main surfactant includes a first main surfactant and a second main surfactant, the first main surfactant and the second main surfactant are different from each other, each of the first main surfactant and the second main surfactant independently including a C8-C18 alkyl sulfate alkali metal salt, and the cosurfactant includes two or more different surfactants, one of which is fatty acid alkyl ester alkoxylate and the remaining one of which is a nonionic surfactant.

According to the present disclosure, a laundry sheet is convenient to use as a sheet detergent, and is completely dissolved in water and thus does not need to be removed after washing, and moreover, it has superior cleaning power, low irritation to the skin, and high softness.

DETAILED DESCRIPTION OF EMBODIMENTS

Figure 1:
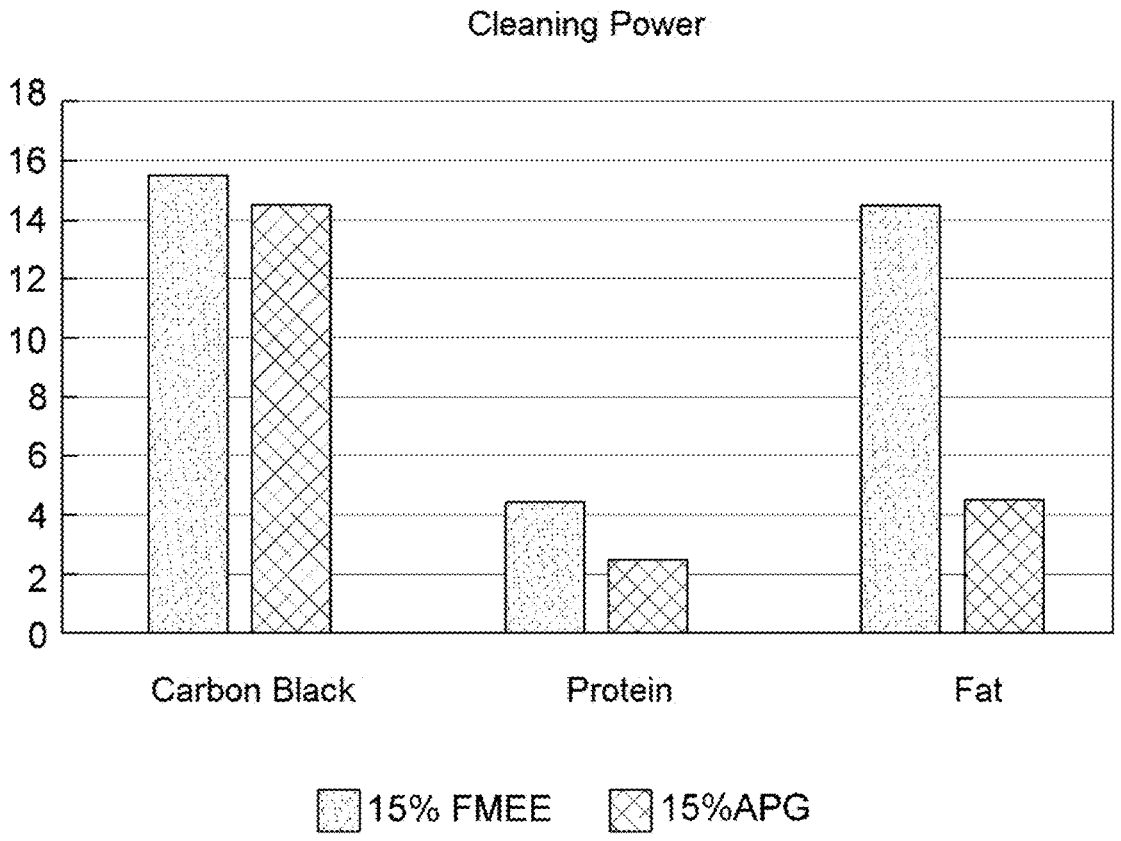
FIGS. 1 and 2 are graphs showing the results of tests on cleaning power and skin irritation, respectively, depending on the type of cosurfactant.

Hereinafter, detailed descriptions will be given of a laundry sheet according to embodiments of the present disclosure.

An embodiment of the present disclosure pertains to a laundry sheet manufactured using polyvinyl alcohol or a polyvinyl-alcohol-based copolymer and containing a surfactant, in which the surfactant includes a main surfactant and a cosurfactant, the main surfactant includes a first main surfactant and a second main surfactant, the first main surfactant, and the second main surfactant are different from each other, each of the first main surfactant and the second main surfactant independently including a C8-C18 alkyl sulfate alkali metal salt, and the cosurfactant includes two or more different surfactants, one of which is fatty acid alkyl ester alkoxylate and the remaining one of which is a nonionic surfactant.

Polyvinyl alcohol or a polyvinyl-alcohol-based polymer is used as the main component for forming a laundry sheet. As a sheet-forming substrate, polyvinyl alcohol or a polyvinyl-alcohol-based polymer is advantageous because sheet formability is higher than polyacrylic acid, polyethylene glycol and polyacrylamide, and solubility in water is higher than that of cellulose. Moreover, the sheet may be easily dissolved in water during washing by using, as the main component for forming the sheet, polyvinyl alcohol or a polyvinyl alcohol polymer, which is a water-soluble or water-dispersible material rather than a woven fabric or a non-woven fabric, which is an insoluble or poorly soluble material.

The molecular weight of the polyvinyl alcohol or polyvinyl-alcohol-based polymer that is used is not particularly limited, so long as it is suitable for use in forming a laundry sheet, but the number average molecular weight thereof is preferably 10,000 to 100,000, more preferably 20,000 to 60,000. The saponification degree of the polyvinyl alcohol or polyvinyl-alcohol-based polymer is also not particularly limited, so long as it is suitable for use in forming a laundry sheet.

The polyvinyl alcohol or polyvinyl-alcohol-based copolymer is preferably contained in an amount of 30 to 40 wt % based on the total weight of the composition.

The surfactant includes a main surfactant and a cosurfactant, as active cleaning ingredients of the laundry sheet.

The main surfactant is a main active cleaning ingredient included in the laundry sheet, and the cosurfactant is an active cleaning ingredient that is additionally and supplementarily used, in addition to the main surfactant.

In an embodiment of the present disclosure, the amount of the main surfactant is preferably 10 wt % or more, more preferably 20 to 36 wt %, based on a total 100 wt % of the laundry sheet.

The main surfactant includes two or more surfactants. Among these surfactants, the one present in a higher amount is referred to as a first main surfactant and the one present in a lower amount is referred to as a second main surfactant. It is preferable that each of the first main surfactant and the second main surfactant is contained in an amount of 10 to 18 wt % based on a total 100 wt % of the laundry sheet.

The first main surfactant and the second main surfactant are different from each other, and each of the first main surfactant and the second main surfactant includes a C8-C18 alkyl sulfate alkali metal salt. In the first main surfactant and the second main surfactant, the number of carbon atoms, the type of alkali metal, or both of them may be different. Here, it is preferable that different types of alkali metals be used. It is preferable for the alkyl sulfate alkali metal salt to have 12 to 16 carbon atoms because of high compatibility with the polyvinyl alcohol or polyvinyl-alcohol-based polymer, which is the film-forming substrate. The metal is preferably an alkali metal, and more preferably sodium or potassium. In particular, the first main surfactant is preferably a lauryl sulfate alkali metal salt, more preferably sodium lauryl sulfate.

In an embodiment of the present disclosure, the cosurfactant is further included, in addition to the main surfactant. Here, the cosurfactant is a component that is used as an active cleaning ingredient, in addition to the main surfactant including the C8-C18 alkyl sulfate alkali metal salt, and includes two or more different surfactants. When the cosurfactant includes two or more surfactants, the one present in a higher amount is named a first cosurfactant and the one present in a lower amount is named a second cosurfactant.

Such a cosurfactant includes alkyl ester alkoxylate, and further includes a nonionic surfactant in addition to the alkyl ester alkoxylate. Moreover, a buffer may be used as the cosurfactant.

In the fatty acid alkyl ester alkoxylate that is used as the cosurfactant, the alkyl group is not particularly limited, but is preferably a C1-C6 alkyl group. The alkoxylate is not particularly limited, but is preferably methoxylate, ethoxylate, or propoxylate. In particular, it is preferably fatty acid methyl ester ethoxylate (FMEE or FAMEE). This is because fatty acid alkyl ester alkoxylate is advantageous in view of cleaning power and skin irritation compared to alkyl ethoxylate (AEO) and alkyl polyglucoside (APG).

The nonionic surfactant that may be used as the cosurfactant may include, for example, at least one selected from the group consisting of polyoxyethylene alkyl ether, coconut diethanolamide, fatty acid alkanolamine, amine oxide, alkyl polyglucoside, methyl polyethylene alkyl ether, and sugar ether. Examples of the polyoxyethylene alkyl ether include polyoxyethylene cetyl ether, polyoxyethylene stearyl ether, polyoxyethylene oleyl ether, and alkyl polyglucoside (APG). In particular, the nonionic surfactant preferably includes coconut diethanolamide.

When two or more surfactants are used as the cosurfactant, respective amounts thereof may be appropriately selected in consideration of sheet formability or cleaning power.

The cosurfactant may also include a component that is used as a buffer, in addition to the nonionic surfactant. Although there is no particular limitation thereon, it is preferable to use 2-morpholinoethanesulfonic acid (MES) monohydrate or N-tris(hydroxymethyl)methyl-2-aminoethanesulfonic acid (TES). In particular, the use of MES monohydrate is preferable.

The sum of the amounts of the cosurfactants is preferably 14 to 22 wt % based on the total weight of the laundry sheet.

When three or more surfactants are used as the cosurfactant, the amount of the first cosurfactant is preferably 7 to 10 wt %, the amount of the second cosurfactant is 5 to 8 wt %, and the amount of the third cosurfactant is preferably 2 to 4 wt %, based on the total weight of the laundry sheet. The types of surfactants that are used as the first cosurfactant, the second cosurfactant, and the third cosurfactant are not particularly limited, so long as they are cosurfactants as described above. For example, the first cosurfactant is preferably MES monohydrate, which is a component that is used as a buffer, the second cosurfactant is preferably fatty acid alkyl ester alkoxylate, and the third cosurfactant is preferably a nonionic surfactant.

The following additional components may be included as set forth in Table 1.

TABLE 1

| Component | Amount (wt %) |
|---|---|
| Glycerin | 0.5 to 6.0 |
| Water-soluble silicone oil | 1.0 to 2.0 |
| Perfume | 0.3 to 1.0 |
| Phenoxyethanol | 0.3 to 1.0 |
| Citric acid | 0.1 to 0.2 |
| Enzyme | 0.01 to 0.02 |

In order to improve cleaning performance or film formability, the laundry sheet according to an embodiment of the present disclosure may further include other components such as a disintegrant, a disintegration aid, a perfume, an enzyme, an optical brightener, an alkali builder, a fabric softener, a bleach, a disinfectant, and the like, within a range that does not impede storage stability, ease of formation, etc.

Examples of the disintegrant/disintegration aid may include starch, cellulose derivatives, sodium chloride, citric acid, glycerin, propylene glycol, etc., and examples of the enzyme may include cellulase, protease, etc. Examples of the alkali builder may include sodium hydroxide, sodium carbonate, sodium bicarbonate, sodium metasilicate, alkaline sodium silicate, neutral sodium silicate, sodium tripolyphosphate, sodium pyrophosphate, sodium borate, zeolite (sodium aluminosilicate), sodium sesquicarbonate, MEA, TEA, etc. Examples of the bleach may include perborate, percarbonate, superphosphate, diacyl, tetraacyl peroxide, etc., and examples of the disinfectant may include sodium hypochlorite, hydrogen peroxide, urea peroxide, etc.

The thickness of the laundry sheet according to the present disclosure is preferably 1 μm to 1 cm, and more preferably 5 μm to 0.5 cm. If the thickness of the sheet is less than 1 μm, the strength is insufficient and it is difficult to sufficiently contain therein active ingredients, making it difficult to obtain desired performance. On the other hand, if the thickness of the sheet exceeds 1 cm, the dissolution time may be lengthened, and cleaning performance may be deteriorated.

A process of manufacturing the laundry sheet according to an embodiment of the present disclosure is described below.

1) Polyvinyl alcohol (PVA) is placed in an emulsifier and is further added with a main surfactant with stirring so that the materials are uniformly and completely dissolved and mixed.

2) The materials, which are uniformly mixed, are added with a perfume and a preservative, dissolved, and mixed.

3) A cosurfactant is then added thereto, other additives are added thereto as necessary, and the resulting mixture is uniformly dissolved with stirring.

(In steps 1) to 3), in principle, all materials have to be added after the previously mixed materials are sufficiently dissolved).

4) A sheet maker is washed and then heated. The material mixture obtained through steps 1) to 3) is placed therein, thereby manufacturing a sheet.

A better understanding of the present disclosure may be obtained through the following examples. However, these examples may be modified in other forms, and are not to be construed as limiting the scope of the present disclosure. The examples of the present disclosure are provided to more completely explain the present disclosure to those skilled in the art.

Example 1

The components of a sheet manufactured through the above manufacturing process and the amounts thereof are shown in Table 2 below.

TABLE 2

| Component | Amount (wt %) |
|---|---|
| PVA | 39.11 |
| Sodium lauryl sulfate | 15.83 |
| Potassium lauryl sulfate | 12.10 |
| MES monohydrate | 9.31 |
| FMEE | 7.76 |
| Amide- or amine-based cosurfactant | 3.10 |
| Glycerin | 4.66 |
| Water-soluble silicone oil | 1.86 |
| Perfume | 0.47 |
| Phenoxyethanol | 0.61 |
| Citric acid | 0.12 |
| Enzyme | 0.01 |
| Water | Remainder (5.06) |

Comparative Example 1

The laundry sheet of Comparative Example 1 was composed of polyvinyl alcohol, surfactants including polyoxyethylene lauryl ether and sodium dodecyl sulfate, 1,2-propanediol, glycerin, sodium acetate, perfume, etc. (LG Household & Health Care®, marketed as 'Tech One Piece Laundry'). The sheet of Comparative Example 1 includes 30% or more of the surfactant (a higher-alcohol-based anionic surfactant, a higher-alcohol-based nonionic surfactant), and also includes an enzyme, an alkali agent, a perfume, a formulating agent, a stabilizer, and baking soda (as a washing aid).

Comparative Example 2

The laundry sheet of Comparative Example 2 was formed using a composition including, based on the total weight of the composition, 29 wt % of PVA, 25 wt % of potassium dodecyl sulfate, 20 wt % of sodium lauryl sulfate, 10 wt % of Laureth-7 and 2 wt % of Laureth-9 as cosurfactants, and other components, such as a filler, citric acid, a perfume and an enzyme.

Test Example 1—Test of Cleaning Power Depending on Cosurfactant (1) Using 15% FMEE as the cosurfactant, cleaning power for carbon black, protein and fat was tested. Also, cleaning power for carbon black, protein and fat was tested using 15% APG (alkyl polyglucoside) as the cosurfactant. The results thereof are shown in FIG. 1.

Figure 2:
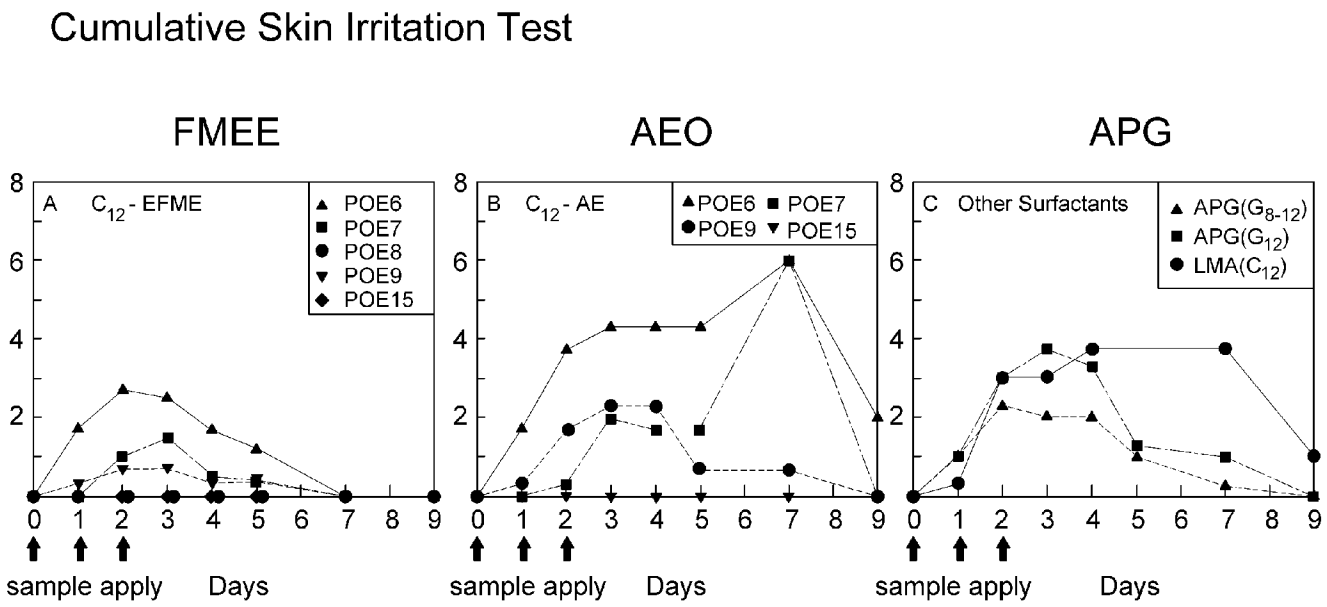

(2) Using 15% FMEE, 15% AEO, and 15% APG as the cosurfactants, each skin irritation test was performed. Skin irritation values were measured and recorded over the course of 9 days. The results thereof are shown in FIG. 2.

Figure 3:
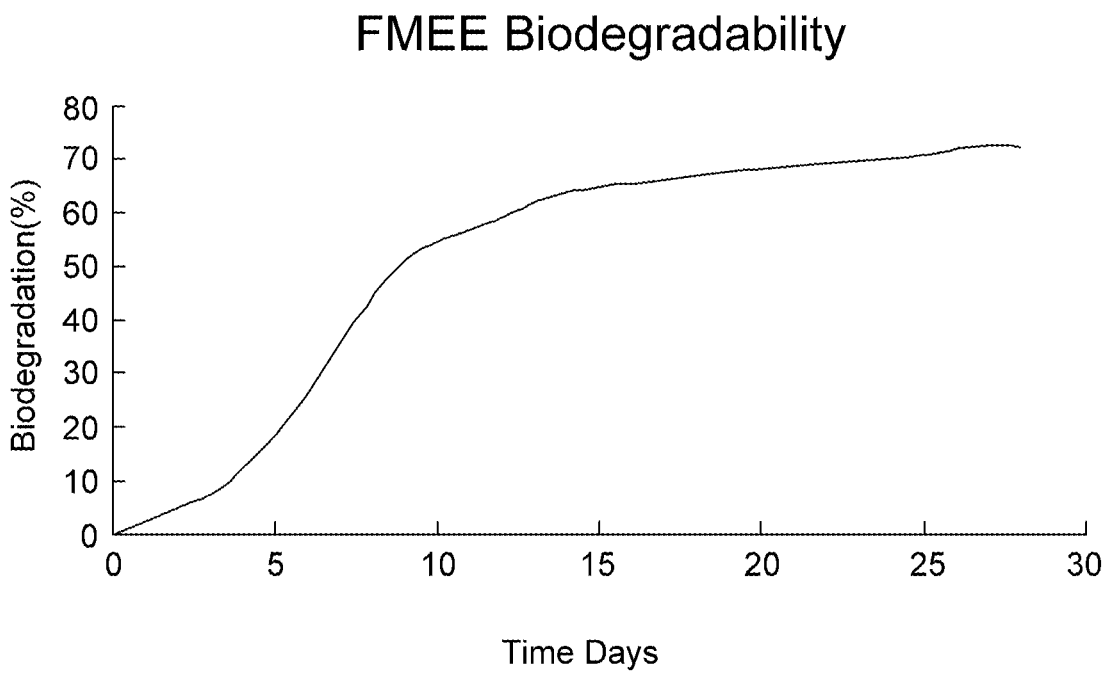
FIG. 3 is a graph showing the results of a biodegradability test when using FMEE (fatty acid methyl ester ethoxylate)

(3) Using FMEE as the cosurfactant, a biodegradability test (OECD 301, B test) was performed, and the results thereof are shown in FIG. 3.

(4) An ecotoxicity test was performed on various alkyl polyglucosides. The results thereof are shown in Table 3 below.

TABLE 3

| Test method | Parameter | $C_{12}C_{14}$-alkyl pg (mg/L) | $C_{10}C_{12}$-alkyl pg (mg/L) | $C_8C_{10}$-alkyl pg (mg/L) | Ref.a | FMEE (mg/L) | AEO (12A8N (mg/L) |
|---|---|---|---|---|---|---|---|
| Fish test | LC50 (96 h) | 3.0 | — | 101 | 12 | 70.5 | 3.0 |
| | | 2.5-5.5 | — | — | 13 | | |
| | | 5.5 | 39.8 | 167 | 14 | | |
| Water flea test | EC50 (49 h) | 7.0 | — | 20 | 12 | 79.2 | 1.9 |
| | | 12 | — | — | 13 | | |
| | | 14.9 | 53.6 | 60 | 14 | | |
| Algal test | EC50 (72 h) | 6.0 | — | 21 | 12 | >100 | 1.2 |
| | | 11b | — | — | 13 | | |
| | | 7.4 | 43.9 | 75 | 14 | | |

Based on the test results, FMEE exhibited superior cleaning power compared to APG. In particular, the cleaning effect thereof on protein and fat was excellent. Moreover, FMEE was regarded as environmentally friendly because it was less irritating to the skin, was highly biodegradable, and had low ecotoxicity.

Test Example 2—Test of Rolling and Softness

A portion of the sheet of Example 1 was cut, wound around a cylinder having a diameter of 50 mm, and observed for cracks or damage after 30 sec. Neither cracks nor damage was observed anywhere on the sheet. Moreover, the softness also appeared to be good.

Test Examples 3 to 6—Test of Cleaning Power

In accordance with the method of GB/T13174-2008, contaminated clothes having a size of 6 cm×6 cm were washed using the sheets of Example 1, Comparative Example 1, and Comparative Example 2 with stirring at 20 Hz for 15 min, and whiteness before and after cleaning was measured to evaluate the cleaning power.

Test Example 3

First, cleaning power for carbon contamination was evaluated. The results thereof are shown in Table 4 below.

TABLE 4

| | Before cleaning | After cleaning | Difference |
|---|---|---|---|
| Example 1 | 9.6 | 16 | 6.4 |
| Comparative Example 1 | 9.3 | 13.5 | 4.2 |
| Comparative Example 2 | 9.5 | 13.6 | 4.1 |

Based on the results of the evaluation of cleaning power for clothes contaminated with carbon black, the sheet of Example 1 exhibited the highest cleaning power. The next highest cleaning power was shown in Comparative Example 2, followed by Comparative Example 1.

Test Example 4

The cleaning power for protein contamination was evaluated, and the results thereof are shown in Table 5 below.

TABLE 5

| | Before cleaning | After cleaning | Difference |
|---|---|---|---|
| Example 1 | 7.6 | 9.5 | 1.9 |
| Comparative Example 1 | 7.7 | 9.6 | 1.9 |
| Comparative Example 2 | 8.0 | 10.3 | 2.3 |

Based on the results of the evaluation of cleaning power for clothes contaminated with protein, the sheet of Comparative Example 2 exhibited the strongest cleaning power. Next, the same cleaning power was exhibited in Example 1 and Comparative Example 1.

Test Example 5

The cleaning power for sebum contamination was evaluated, and the results thereof are shown in Table 6 below.

TABLE 6

| | Before cleaning | After cleaning | Difference |
|---|---|---|---|
| Example 1 | 41.0 | 47.8 | 6.8 |
| Comparative Example 1 | 40.7 | 46.0 | 5.3 |
| Comparative Example 2 | 41.0 | 47.5 | 6.5 |

Based on the results of the evaluation of cleaning power for clothes contaminated with sebum, the sheet of Example 1 exhibited the highest cleaning power. The next highest cleaning power was observed in Comparative Example 2, followed by Comparative Example 1.

Test Example 6

The cleaning power was comprehensively evaluated, taking into consideration all of the cleaning power results of Test Examples 3 to 5. The results thereof are shown in Table 7 below.

TABLE 7

| | Before cleaning |
|---|---|
| Example 1 | 15.1 |
| Comparative Example 1 | 11.4 |
| Comparative Example 2 | 12.9 |

Based on the results of the comprehensive evaluation, the sheet of Example 1 exhibited the highest cleaning power. The next highest cleaning power was found in Comparative Example 2, followed by Comparative Example 1.

Test Example 7: pH Test (Skin Irritation Test)

The pH of each of the sheets of Example 1, Comparative Example 1, and Comparative Example 2 was measured at 1% solubility in an aqueous solution using GB/T 6368. The results thereof are shown in Table 8 below.

TABLE 8

| | Before cleaning |
|---|---|
| Example 1 | 7.6 |
| Comparative Example 1 | 9.82 |
| Comparative Example 2 | 6.90 |

The sheet of Comparative Example 1 is capable of causing skin irritation while washing by hand, but the sheets of Example 1 and Comparative Example 2 are almost neutral and do not cause irritation.

Test Example 8: Solubility Test

Each of the sheets of Example 1, Comparative Example 1, and Comparative Example 2 was cut to a size of 3 cm×3 cm and immersed in water. After 30 seconds, the solubility thereof was compared.

Figure 4:
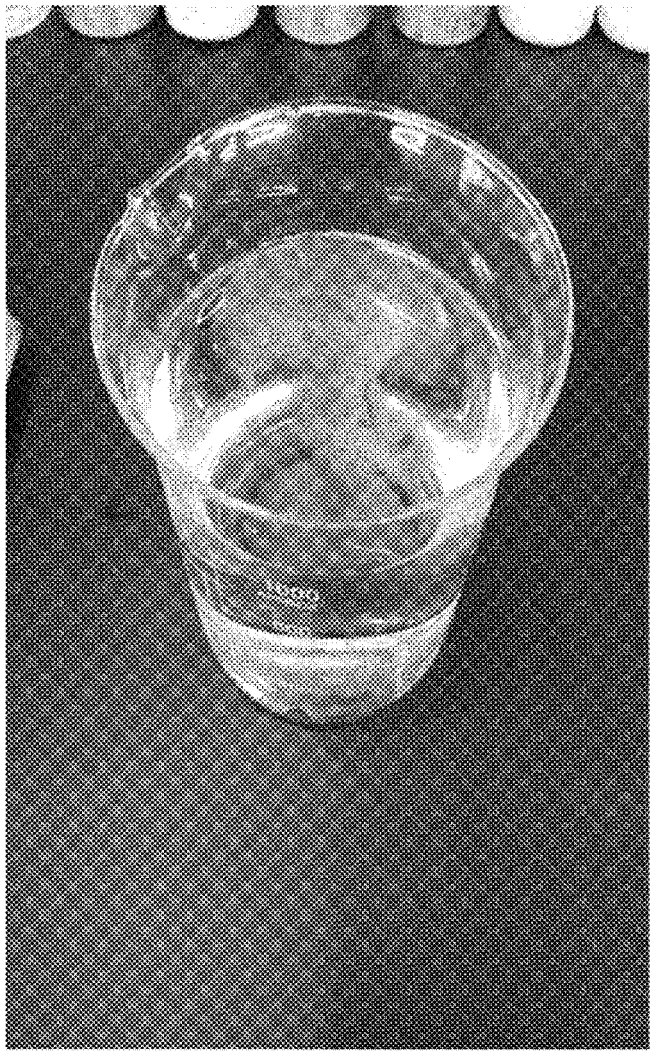
FIGS. 4 to 6 are respective photographs showing the results of tests on solubility, after 30 seconds of adding the samples of Example 1, Comparative Example 1, and Comparative Example 2 to water.
Figure 5:
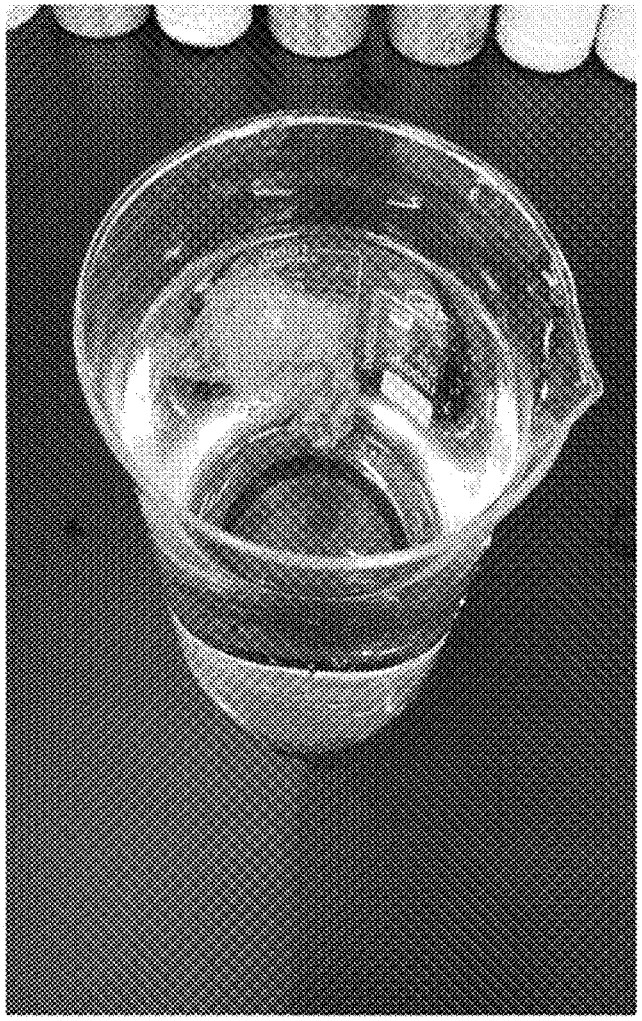
Figure 6:
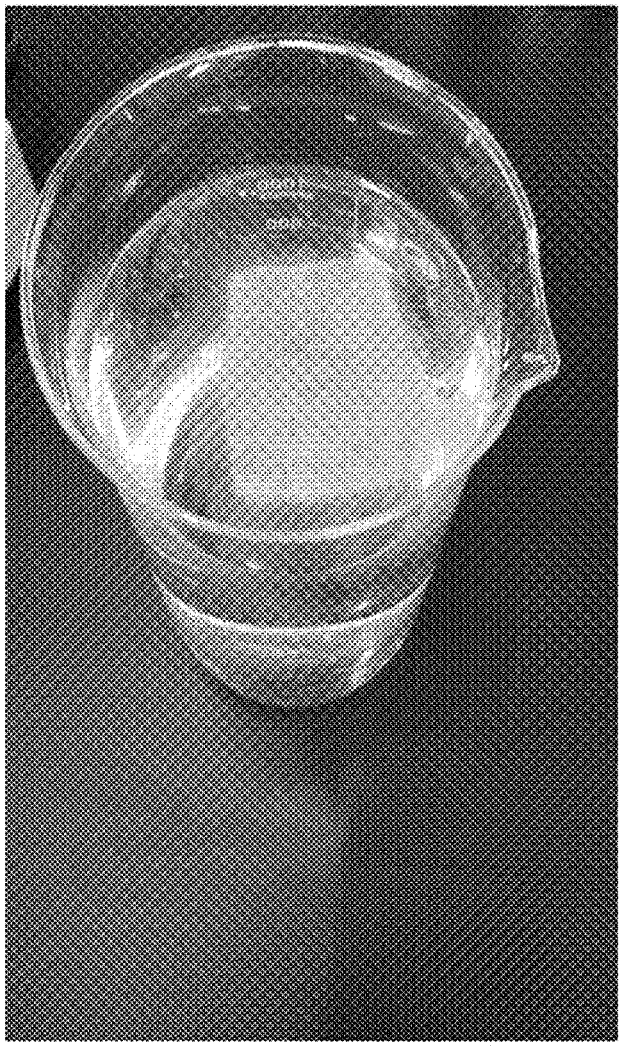

FIGS. 4, 5, and 6 are photographs showing the results of testing the sheets of Example 1, Comparative Example 1, and Comparative Example 2, respectively.

It can be seen that Example 1 had higher solubility than Comparative Examples 1 and 2.

Test Example 9

Each of the sheets of Example 1, Comparative Example 1 and Comparative Example 2 was cut to a size of 3 cm×3 cm and immersed in water. After 60 seconds, the solubility thereof was compared.

Figure 7:
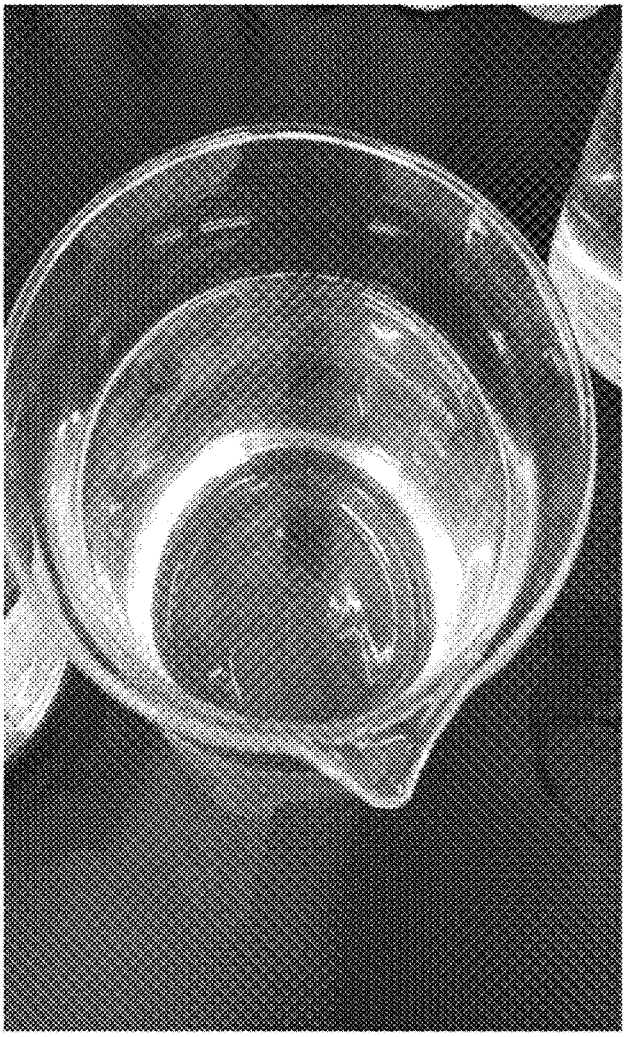
FIGS. 7 to 9 are respective photographs showing the results of tests on solubility after 60 seconds of adding the samples of Example 1, Comparative Example 1, and Comparative Example 2 to water.
Figure 8:
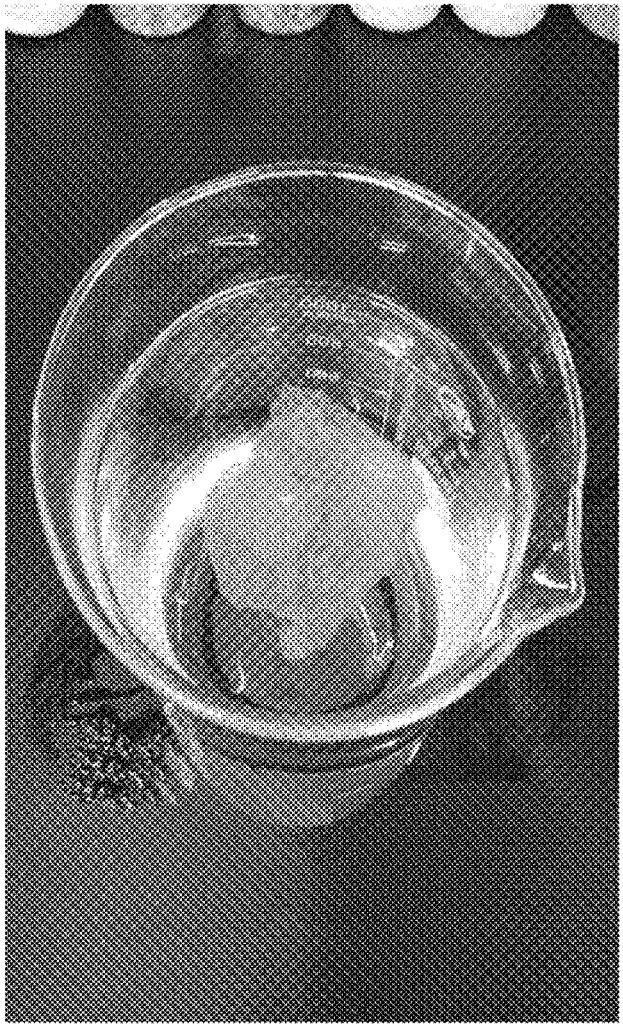
Figure 9:
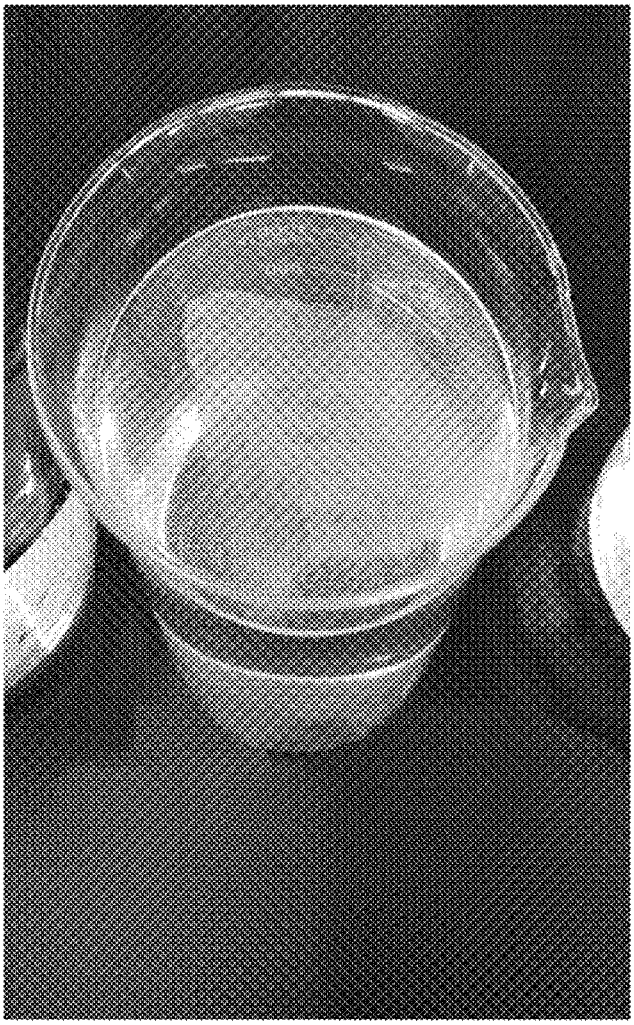

FIGS. 7, 8, and 9 are photographs showing the results of testing the sheets of Example 1, Comparative Example 1, and Comparative Example 2, respectively.

It can be seen that the sheet of Example 1 was almost completely dissolved but that the sheets of Comparative Examples 1 and 2 were not dissolved, and remained.

The invention claimed is:

1. A laundry sheet comprising:

a main surfactant including a first main surfactant and a second main surfactant, wherein the first main surfactant and the second main surfactant are different from each other, each of the first main surfactant and the second main surfactant independently comprising a C8-C18 alkyl sulfate alkali metal salt; and a cosurfactant comprising three or more different surfactants, a first one of which is fatty acid alkyl ester alkoxylate, a second one of which is a nonionic surfactant, and a third one of which is 2-morpholinoethanesulfonic acid (MES) monohydrate.

2. The laundry sheet of claim 1, wherein the first main surfactant comprises sodium lauryl sulfate.

3. The laundry sheet of claim 1, wherein the second main surfactant comprises an alkali metal other than sodium.

4. The laundry sheet of claim 1, wherein the second main surfactant comprises potassium dodecyl sulfate.

5. The laundry sheet of claim 1, comprising 30 to 40 wt % of polyvinyl alcohol or polyvinyl-alcohol-based copolymer, 20 to 36 wt % of the main surfactant based on a total weight of the laundry sheet, and 14 to 22 wt % of the cosurfactant based on the total weight of the laundry sheet.

6. The laundry sheet of claim 1, wherein an amount of the first main surfactant is 10 to 18 wt % based on a total weight of the laundry sheet.

7. The laundry sheet of claim 1, wherein the nonionic surfactant is at least one selected from the group consisting of polyoxyethylene alkyl ether, coconut diethanolamide, fatty acid alkanolamine, amine oxide, alkyl polyglucoside, methyl polyethylene alkyl ether, and sugar ether.

8. The laundry sheet of claim 1, wherein the fatty acid alkyl ester alkoxylate is fatty acid methyl ester ethoxylate.

9. The laundry sheet of claim 1, wherein the cosurfactant comprises three different surfactants, and the three different surfactants comprise, based on a total weight of the laundry sheet, 7 to 10 wt % of the MES monohydrate a first cosurfactant, 5 to 8 wt % of the fatty acid alkyl ester alkoxylate, and 2 to 4 wt % of the nonionic surfactant third cosurfactant.

10. The laundry sheet of claim 1, wherein the laundry sheet is manufactured using polyvinyl alcohol or a polyvinyl-alcohol-based copolymer.

* * * * *